United States Patent [19]

Edgett et al.

[11] Patent Number: 4,788,742

[45] Date of Patent: Dec. 6, 1988

[54] TORQUE MODIFICATION APPARATUS FOR USE WITH A DOOR CLOSER

[75] Inventors: David B. Edgett, San Jose; Richard L. Zunkel, Foster City, both of Calif.

[73] Assignee: Door Control Specialties Co., San Francisco, Calif.

[21] Appl. No.: 134,377

[22] Filed: Dec. 17, 1987

[51] Int. Cl.[4] ..... E05F 1/10

[52] U.S. Cl. ..... 16/79; 16/DIG. 10; 74/517

[58] Field of Search ..... 16/62, 64, 69, 79, DIG. 10; 74/89.2, 517

[56] References Cited

U.S. PATENT DOCUMENTS

| | | | |
|---|---|---|---|
| 1,094,306 | 4/1914 | Cross | 16/79 |
| 1,662,417 | 3/1928 | Cook et al. | 74/517 |
| 3,004,440 | 10/1961 | Pernik | 74/517 X |
| 4,404,863 | 9/1983 | James | 74/89.2 |
| 4,696,500 | 9/1987 | Zunkel | 292/251.5 |

FOREIGN PATENT DOCUMENTS

| | | | |
|---|---|---|---|
| 376548 | 5/1973 | U.S.S.R. | 16/79 |

*Primary Examiner*—Fred A. Silverberg

[57] ABSTRACT

A torque modification device for use with a pocket door which is adaptable to modify the torque applied by a door closer to the door to increase the torque when the door approaches its fully latched condition.

4 Claims, 1 Drawing Sheet

TORQUE MODIFICATION APPARATUS FOR USE WITH A DOOR CLOSER

BACKGROUND OF THE DISCLOSURE

Field of the Invention

The present invention relates to a torque modification apparatus for use with a door closer and more particularly to a torque modification apparatus which varies the torque applied to a door by a door closer to ensure that sufficient torque is provided on the door to effect latching thereof when the door approaches its closed position.

Door closer assemblies are well known in the art. In known door closer assemblies the door is connected to an operating shaft of the door closer by a closer arm. When the door is manually opened the closer arm is rotated to rotate the operating shaft of the door closer. The operating shaft of the door closer is connected to a device to convert rotary motion to linear motion, typically a rack and pinion assembly which is spring biased to bias the door to a closed position. When the door is manually opened the operating shaft of the closer is rotated and the rack and pinion assembly act to compress the door closer spring. The manual compression of the door closer spring provides the closing force to enable the door to close. When the door is released, the compressed spring establishes its biasing force on the rack and pinion assembly which is transferred to the door via the operating shaft and the closer arm to close the door.

The force established by the compressed spring of the prior art door operators is nonlinear. When the door is fully opened the door closer spring, which generally is a helical spring, is fully compressed and the force exerted by the closer spring on the door will be maximized. As the spring expands and effects closing of the door the forces exerted by the door closer spring decrease. Thus, a normal prior art door closer is adapted to exert maximum closing force on the door when the door is in its fully opened position and exerts a decreasing force on the door when the door approaches its fully closed latched condition and the closer spring is expanded. In some known closers multiple lever arms are utilized to increase the torque applied to the door but such lever arm systems such as a four bar linkage do not conveniently fit in compact spaces such as behind a door. In confined spaces such as behind a door a track is used to connect the closer arm to the door and such track systems do not increase the torque applied to the door by the operator.

It is advantageous to increase the closing torque on the door when the door approaches its fully closed latched position. As the door is latched in its closed position, the door must overcome the mechanical forces associated with the latch to effect latching of the door in the closed position. Many known door closers, however, decrease the torque exerted on the door as the door approaches its latched condition. In some cases, the closer does not provide sufficient latching torque on the door to enable the door to overcome the forces of the mechanical latch and positively move to its fully closed latched position. This is especially a problem in buildings which maintain a positive air pressure therein as compared to the outside air pressure. In such pressurized buildings additional latching force is required to overcome the air pressure acting on the door.

Many modern buildings require fire walls and fire doors. These doors are equipped with hardware to assure closing and latching of the doors in the event of a fire to prevent the spread of fire and smoke. In such a fire condition, it is extremely important that the door closer produce sufficient force to latch the fire door during a fire condition. In the known prior art, in order to produce sufficient force to insure latching of the fire door at its closed position a larger door operating spring was utilized in the door closer. However, many fire doors are utilized with hold open devices which hold the door open against the force of the door closer spring until the electrical energy which energizes the hold open device is interrupted to deenergize the hold open device and release the door. If an inordinately large closer spring is utilized, the known hold open devices will not be strong enough to hold the door in its open condition against the biasing force of the closer spring.

Thus, the present invention provides a new and improved torque modification device for use with a door closer which is adaptable to modify the torque exerted by the door closer on the door without the use of a four-bar linkage to insure sufficient torque when the door approaches its fully closed latched position to overcome any forces associated with the mechanical latch and wherein the torque applied to the door when the door is in its held open position is not sufficient to overcome the holding force of known prior art door holders.

SUMMARY OF THE INVENTION

The present invention relates to a new and improved torque modification apparatus for use with a door closer which can be utilized behind a door to modify the torque applied to the door from the door closer to insure sufficient torque is present to effect latching of the door when the door moves to its fully closed position and which does not provide a torque on the door when the door is in its fully opened position which is sufficient to overcome the holding force of known door holder devices.

The present invention relates to a new and improved torque modification apparatus for use with a door closer having an operating shaft which normally biases the door from its open position toward its closed position for modifying the closing torque applied to the door by the door closer including a closer arm connectable to the door for applying a closing force thereto and eccentric means for interconnecting the operating shaft of the door closer and the closer arm for modifying the closing torque applied to the door by the closer arm from the door closer.

The present invention further provides a torque modification apparatus as set forth in the preceding paragraph wherein the eccentric means for interconnecting the operating shaft of the door closer with the closer arm includes a second operating shaft and an eccentric member connected to the second operating shaft for rotation therewith. The eccentric member has a torque applied thereto by the operating shaft of the door closer and acts to modify the torque applied to the second operating shaft and the door by varying the distance from the axis of rotation of the second operating shaft at which the operating shaft of the door closer applies the closing torque to the second operating shaft.

Another provision of the present invention is to provide a torque modification apparatus for use with a door closer having an operating shaft which normally biases the door from its open position toward its closed position at which the door latches including a crank member mountable on the operating shaft of the door closer, a second operating shaft disposed substantially parallel to the operating shaft of the door closer, a closer arm connected to the second operating shaft and to the door to apply a closing force from the door closer to the door and force transfer means for interconnecting the crank member and the second operating shaft for transferring the closing force from the crank member mounted on the operating shaft of the door closer to the second operating shaft and the closer arm to effect closing of the door. The force transfer means acts to increase the closing torque applied from the door closer to the closer arm and the door as the door approaches its fully closed, latched position.

Still another provision of the present invention is to provide a new and improved torque modification apparatus as set forth in the preceding paragraph wherein the force transfer means includes a first member connected to the second operating shaft for rotation therewith and connector means for connecting the first member to the crank member to enable the crank member to transfer the closing force from the operating shaft of the door closer through the connector means to the first member and the second operating shaft. The connector means is adapted to apply the closing force to the first member through a variable radius and angle both of which are varied to increase the closing torque applied to the door when the door approaches its fully closed, latched position.

A still further provision of the present invention is to provide a torque modification apparatus for use with a door closer including a crank member mountable on the operating shaft of the door closer for having the closing force of the door closer applied thereto, a second operating shaft disposed substantially parallel to the operating shaft of the door closer, a closer arm connectable to the second operating shaft and to the door to apply a closing force thereto, flexible force transfer means interconnecting the crank member and the second operating shaft and eccentric means for engaging with the flexible force transfer means to adjust the preload torque applied to the door when the door is in its closed position.

Another provision of the present invention is to provide a new and improved torque modification apparatus for use with a doorcloser including torque transmitting means connectable to the operating shaft for having a closing torque applied thereto, a closer arm connectable to the door for applying a closing torque thereto and an adjustable torque modification device interconnecting the closer arm and the torque transmitting means for modifying the torque applied to the closer arm from the torque transmitting means.

DESCRIPTION OF THE PREFERRED EMBODIMENT

Figures 1, 2, 3:
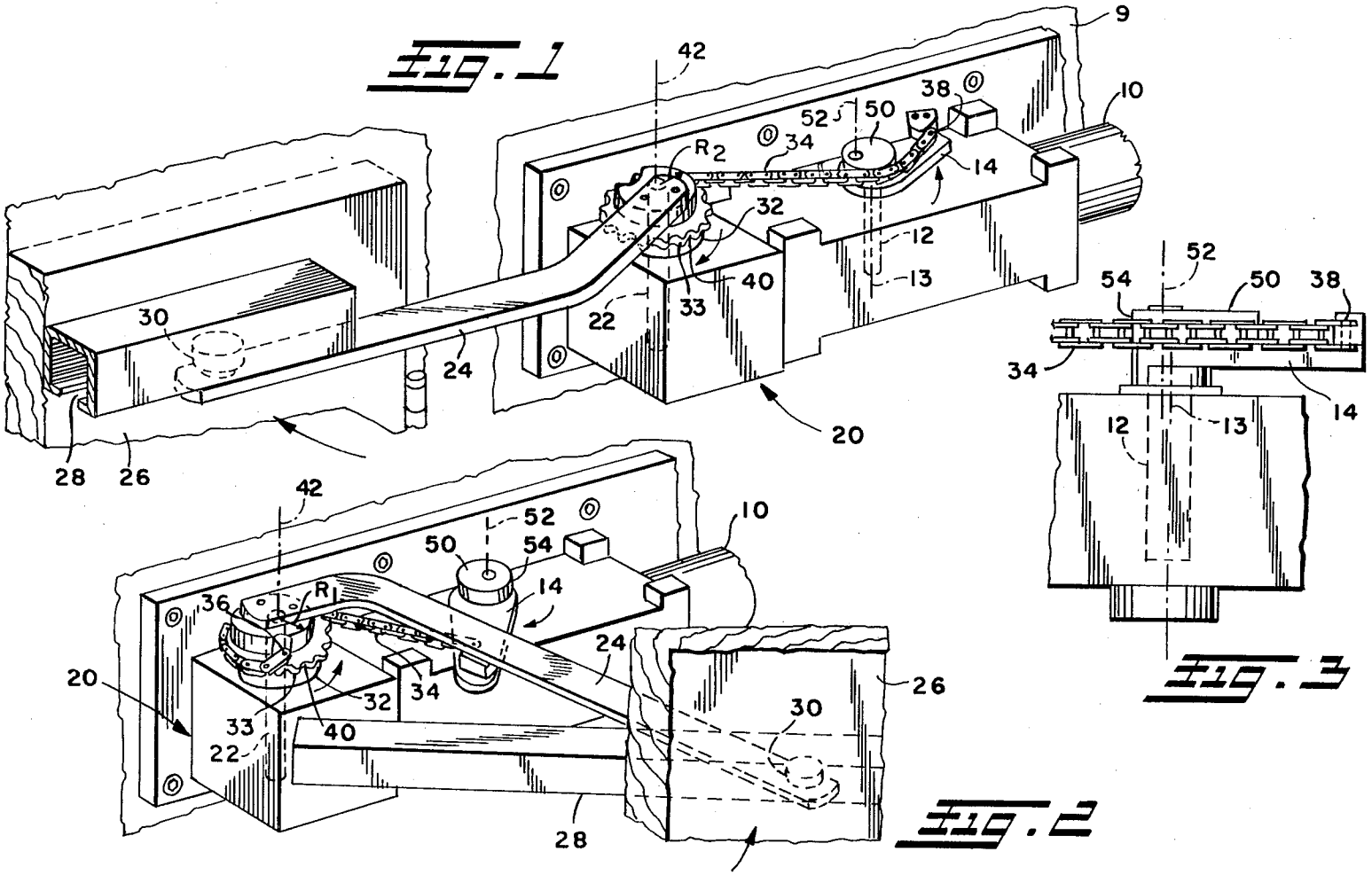
FIG. 1 is a schematic view of a door closer and the torque modification apparatus of the present invention when the door is in its fully closed position.
FIG. 2 is a schematic view of a door closer and the nonlinear torque modification apparatus of the present invention when the door is rotated to its fully opened position.
FIG. 3 is a fragmental view more fully illustrating the operator shaft and crank arm assembly.

A door closer assembly 10 whose construction is well known is shown in FIG. 1. The door closer 10 includes an operating shaft 12 which is normally connected to a closer arm to effect closing of a door 26 in a well known manner. The operating shaft 12 has a position which corresponds to the position of the door 26 and when the door 26 is opened the operating shaft 12 is rotated about an axis of rotation 13 to compress a closer spring, not illustrated, within the door closer 10 in a well known manner. Compression of the closer spring establishes the closing force which the door closer 10 exerts on the door 26 to bias the door 26 toward its closed position, illustrated in figure I. The door closer 10 is adapted to be mounted on a wall 9 which may be in a pocket disposed behind the door. Such a door is commonly referred to as a pocket door.

In the present invention the operating shaft 12 of the door closer 10 has a torque transmitting means such as a crank arm 14 connected thereto for rotation therewith about axis of rotation 13. The position of the crank arm 14 is directly related to the position of the door 26.

A torque modification apparatus 20 is disposed adjacent to the door closer 10. The torque modification apparatus 20 may be directly mounted on the end of the door closer 10 or the wall 9 on which the closer is mounted and includes an operating shaft or pivot 22 which is disposed substantially parallel to the operating shaft 12 of the closer 10. A door closer arm 24 is connected to the operating shaft 22 for rotation therewith. The closer arm 24 is connected to the door 26 by a track 28 in a well known manner which is schematically illustrated in FIG. 1. The door 26 includes a roller track 28 thereon and a roller 30 is provided at one end of the closer arm 24 to engage with the track 28 disposed on the door 26. Rotation of operating shaft 22 and the closer arm 24 therewith effects movement of the door 26 via the closer arm 24, roller 30 and track 28 disposed on door 26.

An eccentric member 32 is disposed on the operating shaft 22 for rotation therewith. While the eccentric 32 and arm 24 are both illustrated as connected to shaft 22, one could be connected to shaft 22 and the other connected to the element connected to shaft 22. The eccentric member 32 is connected to the crank arm 14 via a flexible force transfer means or tension element 34 which in the preferred form is a roller chain but which could take other forms such as a cable. The flexible tension element 34 is connected via a pin 36 to the eccentric member 32 for rotation therewith and via a clamping block 38 to one end of the crank arm 14. The eccentric member 32 includes an outer surface 40 having a plurality of teeth 33 thereon, each of which is adapted to engage with one link of the roller chain 34.

When the door 26 is in its opened position, rotation of the crank arm 14 by the operating shaft 12 of the door closer 10 exerts a force on the roller chain 34 which effects unwinding of the chain 34 from the teeth 33 on the outer surface 40 of the eccentric 32. When the chain 34 unwinds from the surface 40 of eccentric 32 it exerts a torque on the eccentric member 32 to effect rotation thereof and operating shaft 22. Rotation of operating shaft 22 effects movement of the closer arm 24 and the door 26.

When the door 26 is in its position illustrated in FIG. I the door 26 is fully closed and latched. When the door is manually rotated in a counterclockwise direction, from its position illustrated in FIG. I to its position illustrated in FIG. 2, the door 26 will move from its fully closed to its fully opened position. Manual rotation of the door 26 by a user in a counterclockwise direction will rotate arm 24 to effect rotation of the operating shaft 22 which in turn will effect rotation of the eccentric member 32. Rotation of the eccentric member 32 in a counterclockwise direction will engage teeth 33 with the roller chain 34 to wrap chain 34 around the outer surface 40 of the eccentric member 32 to thereby rotate the crank arm 14 in a clockwise direction as viewed in the figures. Rotation of the crank arm 14 in a clockwise direction will effect rotation of the operating shaft 12 of the door closer 10 to compress the door closer spring in the door closer 10 in a well known manner.

When the door 26 is released from its fully opened position, illustrated in FIG. 2, the compressed door closer spring, not illustrated, of the door closer 10 will effect rotation of the operating shaft 12 of the door closer in a counterclockwise direction which effects rotation of the crank arm 14 in a counterclockwise direction from its position illustrated in FIG. 2 to its position illustrated in FIG. 1. Rotation of the crank arm 14 in a counterclockwise direction will unwrap chain 34 from the eccentric member 32 to effect rotation of the eccentric member 32 in a clockwise direction. Rotation of the eccentric 32 in a clockwise direction will effect rotation of the operating shaft 22 and the closer arm 24 in a clockwise direction to effect closing of the door 26.

The crank arm 14 and the flexible tension element 34 transfer the closing force from the door closer operating shaft 12 to the eccentric member 32 and operating shaft 22. The eccentric member 32 includes the teeth 33 on the outer surface 40 on which the flexible tension element 34 reacts to effect rotation of the eccentric member 32 and operating shaft 22. As the eccentric member 32 rotates, the distance between the axis of rotation 42 of the eccentric member 32 and the point on the outer surface 40 at which the flexible tension element 34 reacts varies due to the eccentricity of surface 40 relative to the axis or rotation 42 of the operating shaft 22 and eccentric 32. As can be seen from the figures, the distance $R_2$ between the axis of rotation 42 and the point at which the flexible element 34 acts on the outer surface 40 of the eccentric 32 in FIG. 1 is greater than the distance $R_1$ between the axis of rotation 42 and the point on the surface 40 at which the flexible element 34 reacts in FIG. 2. Thus, as the door 26 is closed, the distance between the axis of rotation 42 and the outer surface 40 of the eccentric member 32 at the point where the flexible element 34 reacts increases to increase the mechanical advantage of the torque modification apparatus 20.

The torque exerted on the door 26 is proportional to the distance between the axis of rotation 42 and the point on the surface 40 at which the flexible element 34 reacts times the force exerted by the crank arm 14 on the flexible element 34 times the sine of the angle theta between the radius R and the flexible tension element 34 (torque=force×radius×sine $\theta$). Thus, as the distance between the axis of rotation 42 and the point on surface 40 at which the flexible tension element 34 reacts increases, the closing torque exerted on the door 26 will increase (assuming a constant angle theta). The eccentric member 32 is designed to increase the distance between its axis of rotation 42 and the point on the surface 40 at which the flexible tension element 34 reacts as the door approaches its fully closed position. This allows an increasing torque to be applied to the door as the door 26 approaches its fully closed latched condition. This is true even though the force exerted by the crank arm 14 decreases as the door closer spring expands to effect closing of the door.

The eccentric member 32 is also configured to decrease the distance between the axis of rotation and the point on the surface 40 at which the flexible tension element 34 reacts as the door 26 approaches its fully opened position. This decreases the closing torque applied to the door 26 at the door's fully opened position even though the force exerted by the crank arm 14 on the flexible tension element 34 increases when the door 26 is in its fully opened position due to full compression of the door closer spring. Thus, the eccentric member 32 acts to modify the closing torque applied to the door 26 by the door closer 10. The eccentric member 32 acts to increase the closing force applied to the door 26 when the door approaches its fully closed position to overcome the forces associated with a mechanical latch and decreases the torque applied to the door by the door closer 10 when the door 26 is in its fully opened position. The crank arm 14, if desired, can be eccentrically mounted about the operating shaft 12 of the door closer 10 to further increase the torque applied to the door 26 by the door closer 10 as the door approaches its fully closed latched position.

Such a construction is especially advantageous when the door 26 is utilized with a holding device, not illustrated, and is a fire door which closes upon a sensor, not illustrated, sensing a fire condition. Such a construction is also desirable in a pocket door wherein the closer 10 is located behind the door in a pocket in the wall, when the door is fully opened. By increasing the torque applied to the door as the door approaches its fully closed position, the eccentric member 32 insures that enough torque is applied to the door 26 to overcome the forces associated with the mechanical latch. By decreasing the torque applied to the door 26 when the door 26 is in its fully opened position, the eccentric member 32 enables a known hold open mechanism, such as that disclosed in U.S. Pat. No. 4,696,500 to Richard Zunkel which is hereby incorporated by reference herein, to overcome the closing force exerted by the door closer on the door 26 to hold the door 26 in an open position. This is a distinct improvement over some prior art wherein the torque exerted on the door 26 is maximized when the door is in its fully opened position and minimized when the door 26 approaches its fully closed latched position.

A second eccentric 50 is mounted for rotation about axis 52 on the upper surface of the crank 14 which rotates about axis of rotation 13. The eccentric 50 includes an annular surface 54 which is adapted to engage with roller chain 34 to adjust the tension in chain 34. Rotation of eccentric 50 about axis 52 will engage the outer surface 54 thereof with the chain 34 to adjust the preload torque applied to the door 26 when in its closed position. The eccentric 50 adjusts the chain 34 and preload to compensate for various structures and mounting arrangements. This can be done at an installation site and is especially advantageous to fine tune the closer and torque modification apparatus for the particular application. Crank arm 14 normally acts on the chain 34 through a radius from the axis of rotation 13 to the point at which the chain 34 engages the clamping block 38. However, when the surface 54 of the eccentric 50 engages with the chain 34 it changes the mechanical advantage and modifies the torque exerted by chain 34 by changing the radius from the axis of rotation 13 at which the chain 34 acts. As the radius from the axis of rotation 13 to the point at which chain 34 acts on crank arm 14 decreases the force exerted eccentric 32 will increase. In addition, because the eccentric 50 engages with chain 34 as the door 24 approaches its fully closed position it modifies the angle between the point where chain 34 acts on the surface 40 of the eccentric 36 and the radius R between the axis of rotation 42 and the point on 40 at which chain 34 acts. This modifies the torque applied to the door and allows the torque to be modified at the installation site for the particular installation It should be apparent that the torque modification apparatus 20 can be easily utilized with known prior art door closers 10. The torque modification apparatus 20 can be mounted directly to the door closer 10 incorporated therein, or can be mounted adjacent to the door closer 10 on the surface of a wall in a pocket on which the door closer 10 is mounted. Thus, the present invention provides a relatively simple torque modification device 20 which is easily connected to and mountable with a door closer 10 located in a wall pocket to maximize the torque exerted on the door 26 when the door 26 approaches its fully closed position and which minimizes the closing torque exerted on the door when the door is in its fully opened position.

From the foregoing it should be apparent that a new and improved torque modification apparatus has been provided for use with a door closer having an operating shaft 12 which normally biases the door 26 from its opened position as illustrated in FIG. 2 to its closed position illustrated in FIG. I. The torque modification apparatus 20 includes the closer arm 24 which is connectable to the door 26 for applying a closing torque thereto and means for interconnecting the operating shaft 12 of the door closer 10 with the closer arm 24 for modifying the closing torque applied to the door by the closer arm 24 from the door closer 10. The means for interconnecting the operating shaft 12 of the door closer and the closer arm 24 includes the second operating shaft 22, the eccentric member 32, the flexible tension element 34, and the crank arm 14.

What we claim is:

1. A torque modification apparatus for use with a doorcloser having an operating shaft which applies a closing torque to normally bias a door from its opened position towards its closed position for modifying the closing torque applied to the door by the operating shaft of the doorcloser comprising a closer arm connectable to the door for applying a closing force thereto and eccentric means for interconnecting the operating shaft or the doorcloser with said closer arm for modifying the closing torque applied to the door by said closer arm from the doorcloser, said eccentric means for interconnecting the operating shaft of the doorcloser with said closer arm includes a first eccentric member having teeth thereon and being rotatable about an axis of rotation, said closer arm being connected to said eccentric member for rotation therewith and being connectable to the door to effect movement thereof from the open to the closed position under the influence of the doorcloser, a crank member connectable to the operating shaft of the doorcloser for rotation therewith and means for connecting said crank member to said eccentric member, said crank member applying the closing torque from the operating shaft of the doorcloser to said eccentric member, said eccentric member acting to modify the torque applied to the door by varying the distance from the axis of rotation of said eccentric member at which the crank member is adapted to apply said closing torque from the doorcloser to said eccentric member, wherein said means for connecting said crank member to said eccentric member further includes a roller chain for connecting said crank member and said eccentric member and for engaging the teeth on said eccentric member, further including a second eccentric member mounted on the upper surface of said crank member and having an annular surface which engages with said roller chain to adjust the tension between said crank member and said eccentric member when the door is in said closed position.

2. A torque modification apparatus as defined in claim 1 wherein said roller chain is operable to apply a force to said eccentric member from said crank arm and wherein the force applied to the door by said eccentric member and said roller chain varies in proportion to the variance in the distance from the axis of rotation of the eccentric member at which said roller chain acts to apply the closing force from the doorcloser to said eccentric member.

3. A torque modification apparatus as defined in claim 1 wherein said eccentric means for interconnecting the operating shaft of the door closer with said closer arm modifies the closing torque applied to the door by the door closer by increasing the closing torque applied to the door when the door approaches the closed position.

4. A torque modification apparatus as defined in claim 3 wherein said eccentric member acts to increase the closing torque applied to the door when the door approaches its closed position and decreases the closing torque applied to the door when the door approaches its fully open position.

* * * * *